US011771274B1

(12) United States Patent
Perez et al.

(10) Patent No.: US 11,771,274 B1
(45) Date of Patent: Oct. 3, 2023

(54) TOILET LID AND SEAT CLOSER AND FLUSHING SYSTEM

(71) Applicants: Ariel Arnaldo Perez, Moreno (AR); Nicolás Martín Biach, Ituzaingó (AR)

(72) Inventors: Ariel Arnaldo Perez, Moreno (AR); Nicolás Martín Biach, Ituzaingó (AR)

( * ) Notice: Subject to any disclaimer, the term of this patent is extended or adjusted under 35 U.S.C. 154(b) by 0 days.

(21) Appl. No.: 18/132,584

(22) Filed: Apr. 10, 2023

(51) Int. Cl.
*A47K 13/10* (2006.01)
*E03D 5/04* (2006.01)

(52) U.S. Cl.
CPC ..... *A47K 13/10* (2013.01); *E03D 5/04* (2013.01)

(58) Field of Classification Search
CPC ..... A47K 13/10; E03D 5/04
USPC ..... 4/246.1
See application file for complete search history.

(56) References Cited

U.S. PATENT DOCUMENTS 5,222,260 A * 6/1993 Piper ..... E03D 5/04 16/303
5,289,593 A * 3/1994 Lawrence ..... A47K 13/10 4/246.1
2017/0086628 A1* 3/2017 Henderson ..... A47K 13/10

* cited by examiner

*Primary Examiner* — Christine J Skubinna
(74) *Attorney, Agent, or Firm* — Mariana I. Vernieri

(57) ABSTRACT

A toilet lid and seat closer and flushing system that aims to prevent the spread of diseases and reduce environmental pollution caused by the emission of infectious and polluting bioaerosols during toilet flushing. The system includes a main actuator with dual closing and flushing buttons, a secondary actuator with a strike knob for closing the lid and seat, and a mechanical timer for delaying the water flushing. The system also includes a sealing rubber on the toilet lid and seat to provide a hermetic and antimicrobial barrier. This invention substantially reduces the emission of polluting bioaerosols, contributing to preventive medicine and improving the health of the global population. The system can be incorporated into new toilets or installed externally as an independent kit, making it adaptable to hundreds of millions of existing toilets worldwide.

4 Claims, 4 Drawing Sheets

TOILET LID AND SEAT CLOSER AND FLUSHING SYSTEM

TECHNICAL FIELD

This invention relates to the field of toilet lid and seat closing mechanisms and flushing systems. More specifically, to a system designed to first close the lid and the toilet seat and, after a set minimum of seconds, automatically flush the cistern after the closing, thus eliminating the problem of the outgoing and ascending column emission of "infectious" bioaerosols, which are highly polluting, composed of water particles, fecal matter, urine, all kinds of pathogenic germs (bacteria, viruses, etc.).

BACKGROUND OF THE INVENTION

The emission of bioaerosols after a toilet flush was first studied in the 1950s, when a bacterium was "sowed" in various types of toilets and the bioaerosols produced during the flush were measured. The cultured particles could be trapped in the air 8 minutes after flushing and they were detected at a height of 150 cm from the ground. Toilet flushes produce infectious bioaerosols, small enough to be directly inhaled by the person releasing the flush (microscopic), entering deeply into the lungs, being able to cause contagion by pathogenic germs from third parties and even self-infection. They may remain in the environment for long periods of time (hours, days and even months) and may be transported by air currents. Cross contamination occurs to all kinds of surrounding environments. In addition, pathogens can be transmitted through all kinds of inanimate objects (fomites) on all bathroom surfaces, by indirect contact (infected hands touch the mucous membranes of the mouth, nose or eyes, generating contagion).

This means that there is a very serious risk of spreading infectious germs present in the toilet up to 4 and a half meters away. If there is a family member with a mild, serious or fatal illness, the toilet flush causes splashes, invisible to human sight, or particle aerosol that can be inhaled, come in contact with the mucosa of the eyes-nose-mouth, or deposited on contact surfaces around the bathroom, producing imminent contagion.

By not closing the toilet lid, pathogenic germs are deposited on absolutely all surfaces and/or fomites inside the bathroom, they remain on your body, on your cell phone, and can be transported to environments where there is food and other objects. It is definitely bad for health. Urine is also dangerous, as it can transmit infectious agents when it comes into contact with the mucous membranes of the eyes-nose-mouth. The process that occurs when flushing, lowering the toilet lid, and in which an "infectious microbial bomb" explodes and disperses with the swirling water, is called: "Toilet plume", causing a huge cloud of particles that splash all over the bathroom. The toilet can contain urine, blood, sperm, feces, viruses, bacteria, fungi, vomit, thousands of infectious agents, which are capable of transmitting diseases, such as hepatitis A, B, E, tuberculosis, gastritis, cholera, dysentery, *salmonellosis*, shigellosis, amoebiasis, giardiasis, COVID-19 and many other diseases. It is noteworthy that enteric and gastroenteric diseases are the main cause of death of children from 0 to 6 years of age worldwide.

The World Health Organization warned that diseases can be spread through fomites (examples of surfaces contaminated by not lowering the lid: floor, bidet, mirrors, faucets, door, walls, towels, shower curtain, sink, label handle door, toothbrushes, combs, toilet paper). If an object is contaminated with a pathogen such as a virus, it is capable of being transferred from one individual to another when they touch it with their hands and later make contact with the mucous membranes of the eyes-nose-mouth. For these reasons, the WHO recommends lowering the toilet lid. In addition, data from the United Nations and the World Health Organization report that 600 million families share a toilet with other families worldwide. COVID-19 is spread in the feces of infected people, which helps explain why it spreads so quickly. Feces are another contagion vehicle, in addition to the airway. The finding of live virus particles in stool samples indicates a fecal-oral route. The virus was found in oral, anal, and blood swabs. This indicates that infected patients, both symptomatic and asymptomatic, are capable of eliminating the pathogen through the fecal-oral route and causing contagion.

Despite the efforts of the prior art to address the issue of the emission of bioaerosols after a toilet flush, these solutions have several shortcomings, due to the fact that more than 98% of the world's population does not manually lower the toilet lid before flushing. For example, US patent U.S. Pat. No. 5,794,277A "Automatic toilet seat closing device", discloses an automatic toilet seat closing device that closes the seat after use. Although it uses a timer to close the lid, it is not associated with automatic water discharge. Therefore, this device does not address the issue of the emission of bioaerosols during the flush, as the toilet lid remains open during the flush, allowing the bioaerosols to be released into the air.

Similarly, US patent U.S. Pat. No. 5,307,524A "Automatic toilet seat device" discloses an automatic toilet seat device that closes the seat after use. However, this device also does not address the issue of the emission of bioaerosols during the flush, as the flushing mechanism is activated before the toilet seat is closed.

In the same sense, US patents U.S. Pat. No. 4,491,989A "Closure device for toilet seats" and U.S. Pat. No. 5,222,260A "Toilet cover closure device" disclose closure devices for toilet seats that automatically close the seat after use. However, these devices also do not address the issue of the emission of bioaerosols during the flush. In the first one, the seat and lid are automatically lowered when the tank is activated. There is no timer to wait for the lid to close before flushing, while in the second one the water is first released, and this discharge is what activates the lowering of the seat.

Lastly, US patent U.S. Pat. No. 5,907,873A "Toilet lid/seat closing return mechanism" discloses a toilet lid/seat closing return mechanism that automatically closes the seat after use, and the Japanese patent JP2004129835A "Automatic toilet lid closing device" discloses an automatic toilet lid closing device that automatically closes the toilet lid after use. However, these two devices do not address the issue of the emission of bioaerosols during the flush, since they lower the seat and lid automatically when the tank is activated, with no timer to wait for the lid to close first.

For these reasons, we believe that providing a sequential toilet lid (or lid and seat) closer and flushing system that addresses the issue of the emission of bioaerosols after a toilet flush, by ensuring that the toilet lid is properly closed before proceeding to the flush, constitutes the solution to a long felt unresolved problem and need and advances the field. Even more so, if the system is easy to install and use, with a simple and intuitive operation, it is durable and requires minimal maintenance, it is also aesthetically pleasing and can be easily adapted to different bathroom decor.

SUMMARY OF THE INVENTION

The present invention aims to provide a sequential closure of the toilet lid or lid and seat and automatically activate the flush seconds later, to avoid the problem of the emission of polluting bioaerosols. Accordingly, the present invention provides a sequential toilet lid (or lid and seat) closer and flushing system including a main actuator with a double button panel for dual water discharge, in which the first button, designed for urination, closes both the lid and the sit (or only the lid if the seat was already down) and subsequently flushes a low flow of water, while the second button, designed for sitting use of the toilet, closes only the lid (or the lid and seat if the seat was already up) and flushes with high water flow. For this to happen smoothly, the toilet seat and lid hinges must be "Soft Close" hinges. Adjusting/manufacturing the hinges of the covers and seats for an extremely fast dropping of 2 to 3 seconds is preferred. The mechanical timer can be set to different periods of time but, when doing so, the closing time of the hinges must be considered, in order to give them enough time for closing completely before flushing. For example, for hinges that close the lid in 2 to 3 seconds, setting the mechanical timer to wait for four seconds before flushing would be appropriate. Also included are a connector rod connecting the main actuator to a secondary actuator, a toilet lid with a rubber sealing between the lid and seat, a toilet seat with a rubber sealing between the seat and bowl, a toilet bowl, a secondary actuator, a panel fixing screw that allows the panel to be fixed to an existing lid by inserting an internal lock into the hole typically found in covers and fixing it with the screw to create a "sandwich," a toilet tank, a closing button number 1, which closes the lid (or lid and seat) and then flushes with low flow, a closing button number 2, which closes the lid (or lid and seat) and then flushes with high flow, an internal lock for fixing the button panel to an existing lid in the same manner as the panel fixing screw, a second panel fixing screw, a water drain valve, a secondary actuator support, an actuator cover, a secondary actuator strike knob for closing the lid and seat or just the lid or seat, an articulated link connecting the rod to the secondary actuator, a support and pivot axis for a lever, two regulatory screws or clearance for adjusting the time between the closing of the lid (which happens first) and the activation of the water drain valve (which happens next). The regulatory screws act as a mechanical timer, delaying the discharge of water for a few seconds until the moment in which the lid is closed. The system also includes two second degree levers, one between a button and the regulatory screws and the other one between the other button and the same regulatory screws, with the pivot for both levers being the pivot axis. The mechanical timer that allows sequential closing can be programmed for different time intervals, including the option of zero seconds, which in this case makes the operation of the entire system simultaneous (rather than sequential).

Moreover, the current invention can be adapted and installed in the systems detailed below:

- System with flush button installed on the wall. Concealed cistern in the wall.
- Flushometer system for flushing, also called Diogenes type lever valve system.
- System with a hanging cistern where the toilet is connected with a bellows or elbow to the cistern.

High Global Impact on Public and Private Health

Four main objectives of the system are to contribute to preventive medicine, to improve the health of the entire population worldwide, (global impact), to avoid contagion of diseases and in many cases deaths by avoiding contagions, and to generate a high impact in the fight against environmental pollution that in this particular case affects the entire built environment (intra-environmental, intra-hospital, intra-buildings in general, etc.) The benefit is for everyone: public restrooms, homes, shopping malls, business, restaurants, hospitals, hotels, airplanes, schools, universities, cruises and more. The system works by allowing the user to activate the dual water discharge feature using either of the two closing buttons, numbered 1 and 2. When one of the buttons is pressed, it activates the main actuator, which in turn activates the secondary actuator through the connector rod. The secondary actuator then moves the strike knob, which can be used to close either the lid and seat, or the lid only (whatever is open). The movement of the strike knob is controlled by the articulated link between the rod and the secondary actuator.

When the water draining valve is activated, pressing one of the closing buttons, in turn starts the timer which, seconds later, automatically activates said water flushing. The primary actuator, the connecting rod, and the secondary actuator work together to control movement of the strike knob and activation of the water draining valve.

The panel fixing screw and internal lock allow the panel with the closing buttons to be easily attached to an existing toilet lid, creating a "sandwich" with the internal lock and cover. The water cistern stores the water used for flushing the toilet. When one of the closing buttons is pressed, the lid close actuation is first triggered, then the flush valve opens, allowing water to flow from the cistern into the toilet bowl and flush waste and sewage out of the bowl through the drainpipe. The regulatory screws can be used to adjust the time between the closing of the lid and the activation of the water drain valve, allowing the user to customize the timing of the flush. The two second degree levers provide a mechanical connection between the closing buttons and the regulatory screws, allowing the user to activate the water discharge feature by pressing either of the buttons.

The system substantially reduces the emission of bioaerosols by closing the lid and seat, (or just the lid if the seat is already down), before flushing the toilet, as the seat is also complemented with a sealing rubber on the toilet bowl and the lid with a sealing rubber bellows against the seat, acting as a hermetic and antimicrobial barrier. In the case that the seat is up, when the toilet lid is closed by the mechanism this motion also closes the toilet seat simply because of gravity. Other materials with specific characteristics that offer the hermetic function that was mentioned earlier can also be incorporated. An accessory handle on the proximal end of the seat is also considered so that it can be raised without contact on it. It could be made of stainless steel, for example, to facilitate its sanitization and avoid disease transmission. The goal of the system is achieved through the use of a secondary actuator, which is activated by the main actuator when a closing button is pressed. The secondary actuator moves a strike knob, which is used to close the lid and seat (or just the lid if the seat is already down). The movement of the strike knob is controlled by an articulated link between the rod and the secondary actuator. The secondary actuator and the connecting rod can be used internally (when the new product comes out of the factory) or as a mechanism than can be completely installed externally, which gives the possibility of commercializing it as an independent kit.

When the toilet is flushed, the water and waste in the bowl are forced out through the drainpipe, and the closing of the helps to contain the bioaerosols within the toilet bowl and prevent them from being released into the air. This system, which can leave the factory already incorporated into new toilets, can also be used and marketed as an independent kit to be adapted to the hundreds of millions of existing toilets worldwide. In this last case, the existing flushing mechanism of the toilet must be removed first and replaced by the system described herein.

DETAILED DESCRIPTION AND BEST MODE OF IMPLEMENTATION

Figure 1:
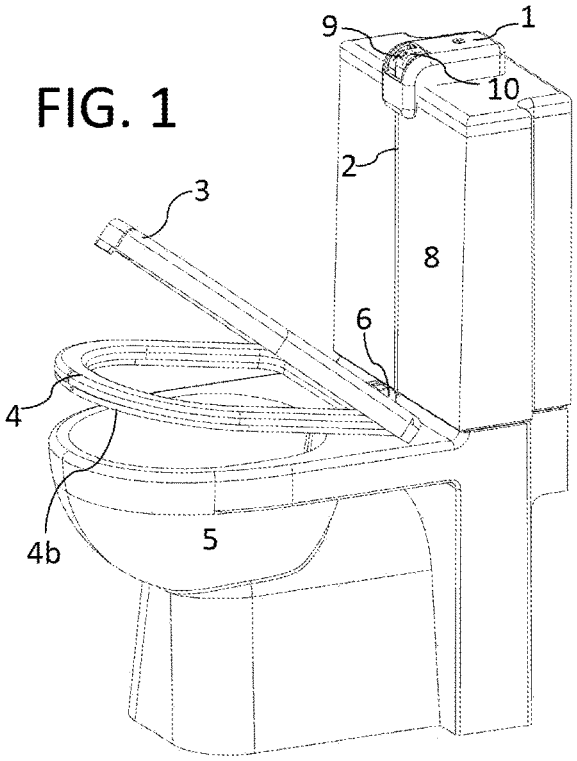
FIG. 1 is a perspective view of an embodiment of a toilet with an installed toilet lid and seat closer and flushing system in accordance with the present invention. The seat is completed with a rubber seal on the toilet bowl and the lid with a rubber seal against the seat.

The present invention refers to a toilet lid and seat closer and flushing system with mechanical timer, which is particularly useful for avoiding the emission of bioaerosols after a toilet flush. The system is composed of a main actuator responsible for activating the flush in the toilet cistern through the closing buttons (which are also delayed flush buttons) and connected to the secondary actuator through a connector rod. The toilet lid is equipped with a sealing rubber to provide a hermetic seal against the toilet seat. The toilet seat is also equipped with a sealing rubber to provide a hermetic seal against the toilet bowl. The secondary actuator is responsible for activating the closing of the toilet lid (or lid and seat) through the strike knob. The secondary actuator is supported by the secondary actuator support and covered by the secondary actuator cover. The system is installed in the toilet cistern and is activated through the closing buttons located on a combined button panel. The panel is fixed to the toilet cistern using panel fixing screws. The water flush is activated after a delay determined by the regulatory screws, which act as a mechanical timer, in such way that the discharge will only occur after the sit and lid have been closed. The second-degree levers are responsible for transmitting the force from the closing buttons to the main actuator and the regulatory screws, respectively. The pivot axis of the second-degree levers is supported by the support.

The toilet lid (or lid and seat) closer and flushing system of the present invention significantly improves hygiene in toilet environments by preventing the emission of bioaerosols during flushes. It is easy to install and can be easily adapted to existing toilets. The application of this system can achieve a global impact (social, economic, sanitary), contributing to preventive medicine and significantly improving the level of public health of the whole population worldwide. It is capable of avoiding contagion of diseases of low, medium and high complexity (in many cases lethal), besides contributing to the fight against environmental pollution (intra-housing, hospital, etc.).

The system technically achieves:

a) Completely eliminating the transmission and contagion of thousands of diseases through the fecal-oral and urine-oral routes (directly or indirectly) derived from the infectious microscopic bioaerosol column (formed by fecal particles and pathogen germs) from toilets (invisible to the naked eye), to avoid the spread and transmission of diseases.

b) Preventing in many cases deaths in all the inhabitants of the world, regardless of place, country, sex, age and purchasing power.

c) Avoiding the huge suffering of contracting some of the diseases detailed below.

d) Decreasing the death rate worldwide, and also a great economic benefit for public health: the governments of each country will spend less on hospital care.

Diseases Transmitted Via the Fecal-Oral and Urine-Oral Routes

Following is a list of mild, severe and fatal infectious diseases transmitted by the fecal-oral and urine-oral routes, through the pathogenic germs that generate them (viruses, bacteria, protozoa, etc.). It is important to highlight that this list of 47 diseases is not exhaustive and definitive. In reality, there are even more, generated by thousands of existing strains, so the number of diseases to avoid is measured in the hundreds or thousands. By way of example, in a single flushing of water, feces can contain up to 200 Rotavirus cells, 20 billion *Shigella* Bacteria and 100,000 parasite eggs.

1. Hookworm disease

Infectious agent that produces it: nematode/worm/parasite. Hookworm disease caused by *Necator americanus. Ancylostoma duodenale. Ancylostoma* brasiliense. *Ancylostoma ceylanicum.*

Symptoms: anemia, abdominal pain, cough, bloody diarrhea, fatigue, fever, rash, excessive weight loss, lung problems, gastrointestinal problems, heart failure, etc.

Severity level: mild, severe and fatal.

2. Balantidiasis
Infectious agent that produces it: protozoon. *Balantidium coli.*
Symptoms: diarrhea with blood and pus, nausea and vomiting, excessive weight loss, severe dehydration, high fever, headache, etc.
Severity level: mild, severe and fatal.
3. Botulism
Infectious agent that produces it: bacteria. *Clostridium botulinum*
Symptoms: abdominal pain, constipation, vomiting, fatigue, blurred or double vision, difficulty speaking, swallowing and breathing, muscle paralysis, loss of reflexes, etc.
Severity level: mild, severe and fatal.
4. Mononucleosis
Infectious agent that produces it: virus. Cytomegalovirus.
Symptoms: fever, fatigue, sore throat, muscle aches, etc.
Severity level: mild, severe and fatal.
5. Cholera
Infectious agent that produces it: bacteria. *Vibrio cholerae.*
Symptoms: intense diarrhea, severe dehydration, vomiting, muscle cramps, hypovolemic shock, blood pressure alteration, etc.
Severity level: mild, severe and fatal.
6. Ebola
Infectious agent that produces it: virus. Ebola virus.
Symptoms: pain in the abdomen, headache, throat, joints, muscles and chest. Dehydration, fever, diarrhea, vomiting blood, coughing up blood, etc.
Severity level: mild, severe and fatal.
7. Strongyloidiasis
Infectious agent that produces it: ascarid. *Strongyloides stercoralis.*
Symptoms: cough, rash, diarrhea, vomiting, etc.
Severity level: mild, severe and fatal.
8. Bacillary and Amoebic Dysentery
Infectious agent that produces it: bacteria. *Shigella* for Bacillary Dysentery, and Amoeba called *Entamoeba histolytica* for Amebic Dysentery.
Symptoms: bloody diarrhea, abdominal pain, colic, fever, dehydration, cramps, excessive weight loss, etc.
Severity level: mild, severe and fatal.
9. Enteritis caused by Rotavirus
Infectious agent that produces it: virus. Rotavirus.
Symptoms: abdominal pain, cramps, colic, excessive weight loss, watery diarrhea, vomiting, dehydration, high fever, etc.
Severity level: mild, severe and fatal.
10. Enteritis caused by Adenovirus
Infectious agent that produces it: virus. Adenovirus.
Symptoms: diarrhea, abdominal pain, blood in the urine, bladder pain, high fever, etc.
Severity level: mild, severe and fatal.
11. Enteritis caused by *Campylobacter*
Infectious agent that produces it: virus. *Campylobacter.*
Symptoms: diarrhea, abdominal pain, blood in the urine, bladder pain, high fever, etc.
Severity level: mild, severe and fatal.
12. Enteritis caused by *Yersinia Enterocolitica*
Infectious agent that produces it: bacteria. *Yersinia.*
Symptoms: diarrhea, abdominal pain, blood in the urine, bladder pain, high fever, etc.
Severity level: mild, severe and fatal.
13. Enterocolitis caused by *Clostridium Difficile*
Infectious agent that produces it: bacteria. *Clostridium difficile.*
Symptoms: diarrhea, abdominal pain, blood in the urine, bladder pain, high fever, etc.
Severity level: mild, severe and fatal.
14. Enterocolitis caused by Enterovirus
Infectious agent that produces it: virus. Enterovirus.
Symptoms: diarrhea, abdominal pain, blood in the urine, bladder pain, high fever, etc.
Severity level: mild, severe and fatal.
15. Norwalk Gastroenteritis
Infectious agent that produces it: virus. Norwalk.
Symptoms: diarrhea, abdominal pain, blood in the urine, bladder pain, high fever, etc.
Severity level: mild, severe and fatal.
16. Acute viral gastroenteritis
Infectious agent that produces it: virus. Norovirus.
Symptoms: diarrhea, abdominal pain, blood in the urine, bladder pain, high fever, etc.
Severity level: mild, severe and fatal.
17. Acute bacterial gastroenteritis
Infectious agent that produces it: bacteria. Heliobacter *Pylori* (high degree of lethality).
Symptoms: diarrhea, abdominal pain, blood in the urine, bladder pain, high fever, etc.
Severity level: mild, severe and fatal.
18. Giardiasis
Infectious agent that produces it: protozoan parasite. Giardia.
Symptoms: chronic diarrhea, impaired mental and physical development, lactose intolerance, etc.
Severity level: mild, severe and fatal.
19. Hantavirus
Infectious agent that produces it: virus. Hantaviridae.
Symptoms: high and hemorrhagic fever, headache, muscle aches, cough, lung problems, etc.
Severity level: mild, severe and fatal.
20. Hepatitis A
Infectious agent that produces it: Highly contagious liver infection caused by the Hepatitis A virus.
Symptoms: Symptoms include fatigue, nausea, abdominal pain, loss of appetite, and low-grade fever. Joint pain, headache, inflammation of the liver.
Severity level: mild, severe and fatal.
21. Hepatitis B
Infectious agent that produces it: Serious liver infection caused by the Hepatitis B virus.
Symptoms: Symptoms include fatigue, nausea, abdominal pain, loss of appetite, and low-grade fever. Joint pain, headache, inflammation of the liver. Cirrhosis, liver cancer.
Severity level: mild, severe and fatal.
22. Hepatitis E
Infectious agent that produces it: Liver disease caused by the Hepatitis E virus.
Symptoms: Symptoms include jaundice, lack of appetite, and nausea.
Severity level: mild, severe and fatal.
23. Enterohemorrhagic *Escherichia Coli*
Infectious agent that produces it: bacteria. *E. coli*
Symptoms: Cramps, abdominal pain, diarrhea, severe bleeding, intestinal infections, etc.
Severity level: mild, severe and fatal.

24. Enteroinvasive *Escherichia Coli*
Infectious agent that produces it: bacteria. *Escherichia coli*
Symptoms: Cramps, abdominal pain, diarrhea, severe bleeding, intestinal infections, etc.
Severity level: mild, severe and fatal.
25. Enteropathogenic *Escherichia Coli*
Infectious agent that produces it: bacteria. *Escherichia coli*
Symptoms: Cramps, abdominal pain, diarrhea, severe bleeding, intestinal infections, etc.
Severity level: mild, severe and fatal.
26. *Escherichia Coli* Enterotoxins
Infectious agent that produces it: bacteria. *Escherichia coli*
Symptoms: Cramps, abdominal pain, diarrhea, severe bleeding, intestinal infections, etc.
Severity level: mild, severe and fatal.
27. Enteroaggregative *Escherichia Coli*
Infectious agent that produces it: bacteria. *Escherichia coli*
Symptoms: Cramps, abdominal pain, diarrhea, severe bleeding, intestinal infections, etc.
Severity level: mild, severe and fatal.
28. *Escherichia Coli* Diffuse Adhesion
Infectious agent that produces it: bacteria. *Escherichia coli*
Symptoms: Cramps, abdominal pain, diarrhea, severe bleeding, intestinal infections, etc.
Severity level: mild, severe and fatal.
29. Cryptosporidiosis
Infectious agent that produces it: parasite. *Cryptosporidium.*
Symptoms: diarrhea, abdominal pain, blood in the urine, bladder pain, high fever, etc.
Severity level: mild, severe and fatal.
30. *Isospora*
Infectious agent that produces it: parasite. *Isospora Belli.*
Symptoms: diarrhea, abdominal pain, fever, dehydration, etc.
Severity level: mild, severe and fatal.
31. *Bacillus cereus*
Infectious agent that produces it: bacteria. *Bacillus Cereus.*
Symptoms: emetic syndrome or diarrheal syndrome. Fever, dehydration, abdominal pain, headache, bloody stools, abdominal cramps, poisoning, etc.
Severity level: mild, severe and fatal.
32. *Clostridium perfringens*
Infectious agent that produces it: bacteria with eight lethal toxins. *Clostridium.*
Symptoms: watery diarrhea, nausea, colic, abdominal pain, headache, poisoning, etc.
Severity level: mild, severe and fatal.
33. *Staphylococcus*
Infectious agent that produces it: bacteria. Bacilli.
Symptoms: skin infections, boils, blood infections, bone infections, lung infections, poisoning, etc.
Severity level: mild, severe and fatal.
34. *Klebsiella*
Infectious agent that produces it: bacteria. *pneumoniae.*
Symptoms: urinary and biliary tract infections, osteomyelitis, meningitis, septicemia, pneumonia, fever, tachycardia, etc.
Severity level: mild, severe and fatal.
35. Malaria
Infectious agent that produces it: parasite. *Plasmodium.*
Symptoms: abdominal pain, muscle pain. Fatigue, fever, tremors, diarrhea, vomiting, headache, tachycardia, confusion, etc.
Severity level: mild, severe and fatal.
36. Epidemic Pleurodynia or Bornholm Disease
Infectious agent that produces it: virus. Enterovirus.
Symptoms: intense pleural and chest pain. Abdominal pain, fever, myocarditis, etc.
Severity level: mild, severe and fatal.
37. *Salmonellosis*
Infectious agent that produces it: bacteria. *Salmonella.*
Symptoms: diarrhea, fever, abdominal pain, muscle pain and headache, dehydration, bloody diarrhea, excessive weight loss, fatigue, chills, etc.
Severity level: mild, severe and fatal.
38. Poliomielitis
Infectious agent that produces it: virus. poliovirus.
Symptoms: atrophy, fatigue, fever, dizziness, muscle loss, slow growth, headaches, nausea, vomiting.
Severity level: mild, severe and fatal.
39. Rubella
Infectious agent that produces it: virus. Rubella.
Symptoms: fever, nasal congestion, headache, body aches, enlarged neck lymph nodes, body rashes, cardiac disorders, diabetes, thyroid dysfunction, etc.
Severity level: mild and severe.
40. Typhoid Fever
Infectious agent that produces it: bacteria. *Salmonella typhi.*
Symptoms: abdominal pain, muscle aches, headaches, diarrhea, vomiting, fever, fatigue, chills, extreme weight loss, etc.
Severity level: mild, severe and fatal.
41. Shigellosis
Infectious agent that produces it: bacteria. *Shigella*. It has 3 strains.
Symptoms: bloody diarrhea, abdominal pain, headache, intestinal fever.
Severity level: mild, severe and fatal.
42. Trachoma
Infectious agent that produces it: bacteria. *Chlamydia trachomatis.*
Symptoms: blindness (main infectious disease globally). Other symptoms: conjunctivitis, eye irritations.
Severity level: mild and severe.
43. Trichuriasis
Infectious agent that produces it: parasite. *Trichuris trichiura.*
Symptoms: abdominal pain, anemia, malnutrition, bloody diarrhea, rectal prolapse, etc.
Severity level: mild, severe and fatal.
44. Tuberculosis
Infectious agent that produces it: bacteria. Koch's *bacillus.*
Symptoms: chest pain, headache, coughing up blood, fatigue, fever, loss of appetite, breathing difficulties, swollen lymph nodes, weight loss, etc.
Severity level: mild, severe and fatal.
45. *Vibrio Parahaemolyticus* Gastroenteritis
Infectious agent that produces it: bacteria. *Vibrio Parahaemolyticus.*
Symptoms: diarrhea, abdominal and headache pain, nausea, vomiting, fever etc.
Severity level: mild, severe and fatal.

46. Intestinal or extraintestinal yersiniosis

Infectious agent that produces it: bacteria. *Yersinia.*

Symptoms: severe diarrhea, fever, cramps, intestinal pain, etc.

Severity level: mild, severe and fatal.

47. COVID-19

Infectious agent that produces it: infectious disease caused by the SARS-CoV-2 virus.

Symptoms: headache, shortness of breath, chills, muscle aches, pneumonia, fever, cough, tiredness, loss of taste or smell.

Severity level: mild, severe and fatal.

Superbugs

The World Health Organization (WHO) has published a list of superbugs for which new antibiotics are urgently needed. The list includes the 12 most dangerous and deadly families of bacteria worldwide, 7 of which will be mentioned below as they can be transmitted via the fecal-oral route, and 2 via the fecal-oral and urine-oral route. Said published list is a new tool to guarantee that research and development, such as the work carried out in this patent where we developed a preventive product for disease transmission and a complement to medication, responds to urgent global public health needs.

The WHO divides them into three categories based on the urgency in which new antibiotics, drugs, etc. are needed: critical, high or medium priority.

The critical priority group includes multi-resistant bacteria that can cause serious and often fatal infections, such as bloodstream infections and pneumonia.

The second and third levels of the list (the high and medium priority categories) contain other bacteria that exhibit increasing drug resistance and cause common diseases and food poisoning such as *salmonella*, etc.

Predictions suggest that by the year 2050 superbugs can cause 10 million deaths per year worldwide and many of these diseases are of great concern and impact for the United States, for instance.

Priority 1: CRITICAL

*Acinetobacter baumannii*, carbapenem-resistant: Can be transmitted via fecal-oral or urine-oral route.

*Pseudomonas aeruginosa*, carbapenem-resistant: Can be transmitted via fecal-oral or urine-oral route.

Enterobacteriaceae, carbapenem-resistant, ESBL producers: Can be transmitted by the fecal-oral route.

Priority 2: HIGH

*Enterococcus faecium*, vancomycin-resistant: Can be transmitted via fecal-oral route.

*Staphylococcus aureus*, methicillin-resistant (MRSA), with intermediate sensitivity and resistance to vancomycin: Can be transmitted via fecal-oral route.

*Helicobacter pylori*, clarithromycin-resistant: An infectious agent mentioned earlier in the List of Diseases. Can be transmitted via fecal-oral route.

*Campylobacter* spp., fluoroquinolone-resistant: A disease mentioned earlier in the List of Diseases. Can be transmitted via fecal-oral route.

Salmonellae, fluoroquinolone-resistant: A disease mentioned earlier in the List of Diseases. Can be transmitted via fecal-oral route.

Priority 3: MEDIUM

*Shigella*, fluoroquinolones-resistant: A disease already mentioned above in the List of Diseases. It can be transmitted by the fecal-oral route.

In addition, outside the WHO list, there is a strain of superbug called CRE that belongs to the group of Enterobacteriaceae, carbapenems-resistant and is lethal in 50% of cases. It is of great concern to public health because current drugs (between 26 and 28 antibiotics used) do not provide the required result. This strain was classified as a "Nightmare Bacteria" by the Director of the US Centers for Disease Control and Prevention (CDC), Tom Frieden. The CRE superbug can be transmitted through fecal-oral and urine-oral routes. The West Virginia Public Health Office indicated that infected patients often have the bacteria on their skin or hands and spread it through urine, feces, or wounds.

Some general aspects of the present invention have been summarized so far in the first part of this detailed description and in the previous sections of this disclosure. Hereinafter, a detailed description of the invention as illustrated in the drawings will be provided. While some aspects of the invention will be described in connection with these drawings, it is to be understood that the disclosed embodiments are merely illustrative of the invention, which may be embodied in various forms. The specific materials, methods, structures, and functional details disclosed herein are not to be interpreted as limiting. Instead, the intended function of this disclosure is to exemplify some of the ways—including the presently preferred ways—in which the invention, as defined by the claims, can be enabled for a Person of Ordinary Skill in the Art. Therefore, the intent of the present disclosure is to cover all variations encompassed within the spirit and scope of the invention as defined by the appended claims, and any reasonable equivalents thereof.

Referring to the drawings in more detail, FIG. 1 is a perspective view of an embodiment of a toilet with an installed toilet lid (or lid and seat) closer and flushing system in accordance with the present invention. This figure shows the main actuator (1) and the secondary actuator (6) installed in the toilet cistern (8). The main actuator (1) is connected to the secondary actuator (6) via a connector rod (2). The main actuator (1) is a dual closing button panel with buttons (9) and (10) for selecting a partial flush or a full flush. The toilet lid (3) and seat (4) are shown in a semi-opened position, while the toilet bowl (5) is visible below. the toilet seat (4) is also equipped with a sealing rubber (4*b*) to provide a hermetic seal against the toilet bowl (5). Although this seal is useful for preventing the spread of bacteria, some embodiments may not include this feature.

Figure 2:
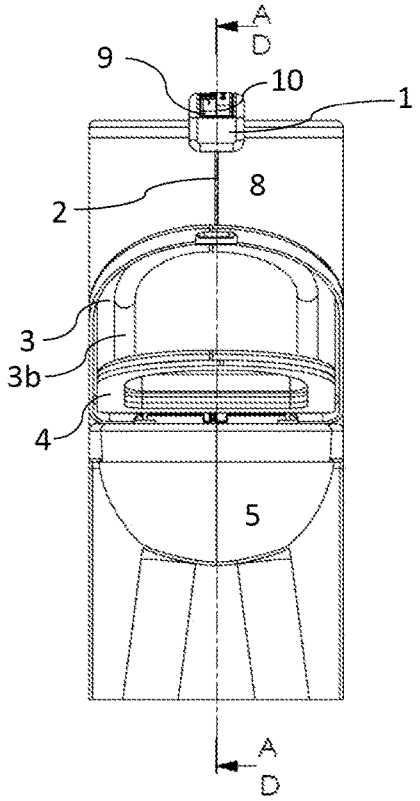
FIG. 2 is a front view of an embodiment of a toilet with an installed toilet lid and seat closer and flushing system in accordance with the present invention. The seat is completed with a rubber seal on the toilet bowl and the lid with a rubber seal against the seat.

FIG. 2 is a front view of an embodiment of a toilet with an installed toilet lid (or lid and seat) closer and flushing system in accordance with the present invention. This figure shows the main actuator (1) and secondary actuator (6) in more detail, as well as the dual closing button panel and buttons (9) and (10). The toilet lid (3) and seat (4) are also shown in a semi-opened position. The sealing rubber (3*b*) of the toilet lid (3) is also shown.

Figure 3:
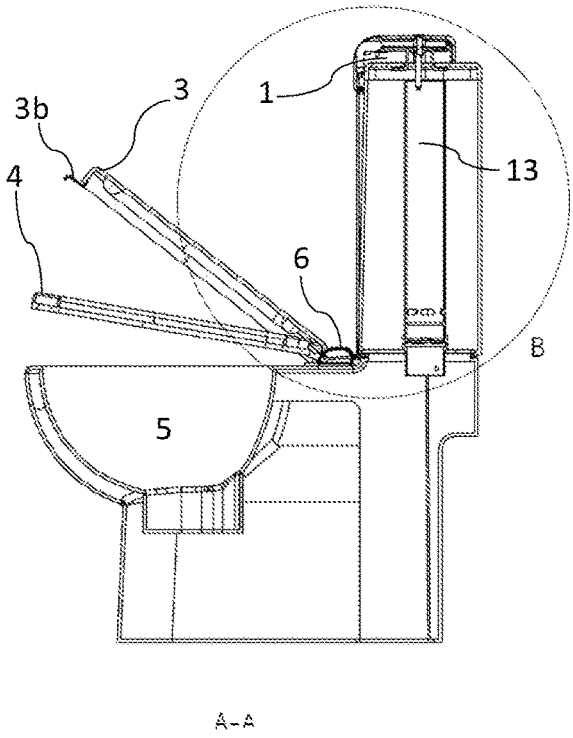
FIG. 3 is a sectional side view of an embodiment of a toilet with an installed toilet lid and seat closer and flushing system in accordance with the present invention. The seat is completed with a rubber seal on the toilet bowl and the lid with a rubber seal against the seat.

FIG. 3 is a sectional side view through line A-A of FIG. 2, of an embodiment of a toilet with an installed toilet lid (or lid and seat) closer and flushing system in accordance with the present invention. This figure shows the internal components of the system, including the main actuator (1) and the secondary actuator (6). The water drain valve (13) is also visible, as well as the toilet bowl (5) and the toilet cistern (8). The toilet lid (3) and seat (4) are also shown in the semi-opened position. An accessory handle (3*b*) is also considered at the proximal end of the lid so that it can be lifted without contact with the lid (3) Similarly a handle could be added for the seat, or both. They can be made of various materials.

Figure 4:
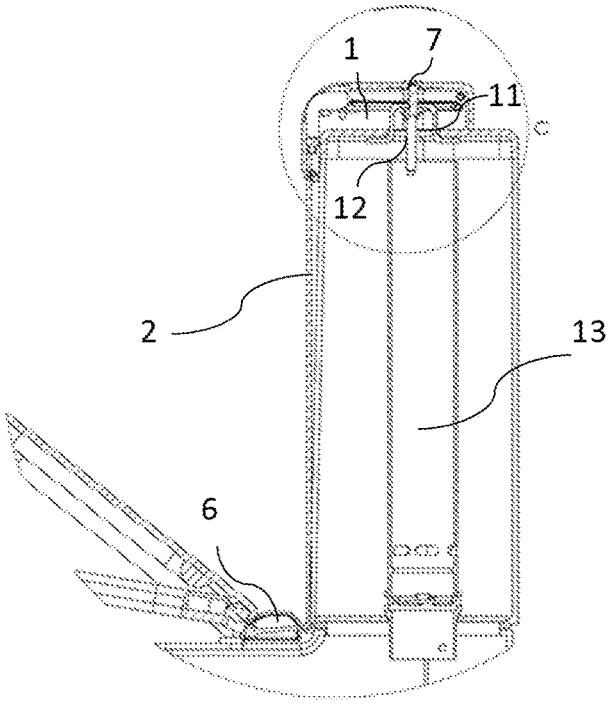
FIG. 4 is an enlargement of the part of FIG. 3 marked with "B".

FIG. 4 is an enlargement of the part of FIG. 3 marked with "B". This figure shows a closer view of the main actuator (1) and the connector rod (2) between the main actuator and the secondary actuator (6). The panel fixing screws (7, 12) are also visible, as well as the internal lock (11) that allows for the secure attachment of the panel to the existing toilet lid.

Figure 5:
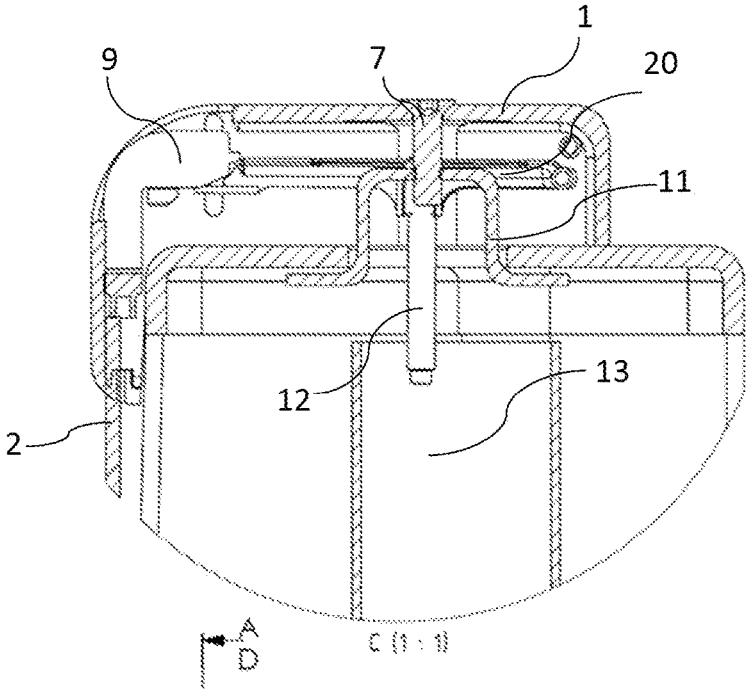
FIG. 5 is an enlargement of the part of FIG. 4 marked with "C".

FIG. 5 is an enlargement of the part of FIG. 4 marked with "C". This figure shows a closer view of the main actuator (1) and its components, including the panel fixing screws (7, 12), the closing button (9) and the internal lock (11). The connector rod (2) and the 2nd degree lever (20) are also shown.

Figure 6:
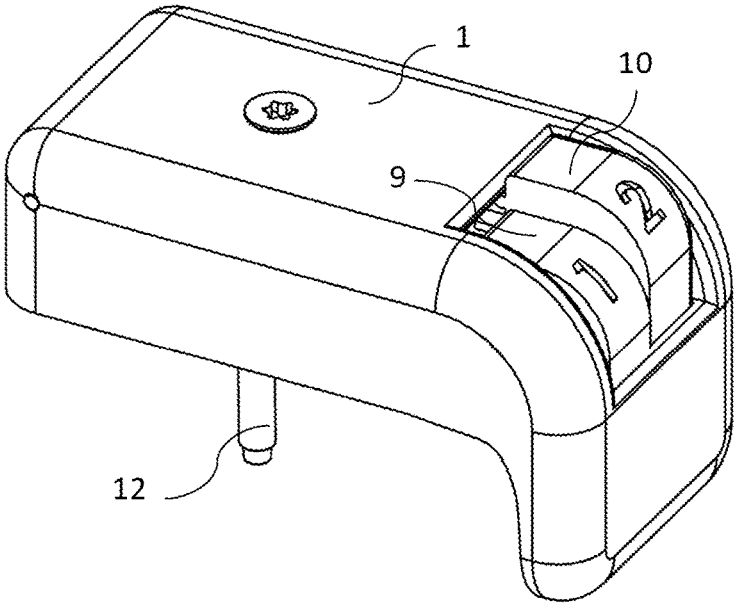
FIG. 6 is a perspective view of an embodiment of a main actuator in a toilet lid and seat closer and flushing system in accordance with the present invention.

FIG. 6 is a perspective view of an embodiment of a main actuator in a toilet (or lid and seat) closer and flushing system in accordance with the present invention. This figure shows the main actuator (1) with the closing buttons (9, 10) and the panel fixing screw (12) visible.

Figure 7:
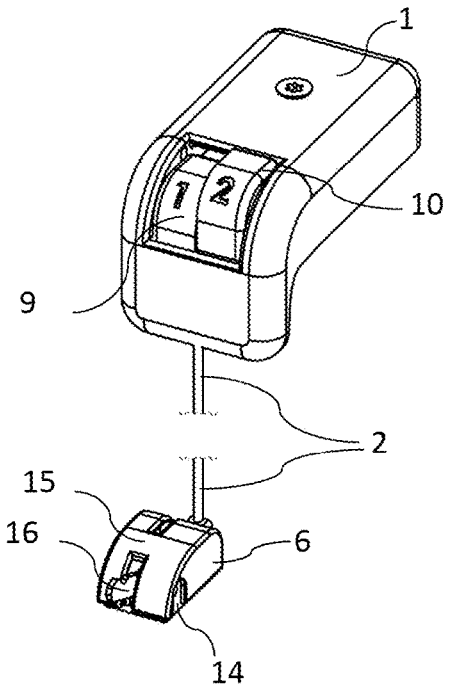
FIG. 7 is a perspective view of an embodiment of a main actuator and secondary actuator in a toilet lid and seat closer and flushing system in accordance with the present invention.

FIG. 7 is a perspective view of an embodiment of a main actuator and secondary actuator in a toilet lid (or lid and seat) closer and flushing system in accordance with the present invention. This figure shows the main actuator (1) and the secondary actuator (6) with the connector rod (2) between them. The closing buttons (9, 10) are also visible. The secondary actuator is shown with its support (14) and cover (15), as well as the strike knob (16) for activating the closing of the lid (or lid and seat).

Figure 8:
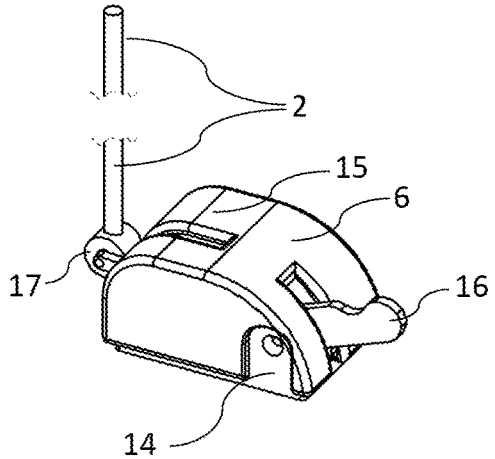
FIG. 8 is a perspective view of an embodiment of a secondary actuator in a toilet lid and seat closer and flushing system in accordance with the present invention.

FIG. 8 is a perspective view of an embodiment of a secondary actuator in a toilet (or lid and seat) and flushing system in accordance with the present invention. In this figure, the secondary actuator (6) is shown in more detail, including the secondary actuator support (14), secondary actuator cover (15), and strike knob (16) for activating the closing of the toilet seat (4) and toilet lid (3). The secondary actuator (6) also includes an articulated link (17) connecting the strike knob (16) to connector rod (2), allowing the secondary actuator (6) to be actuated by the main actuator (1).

Figure 9:
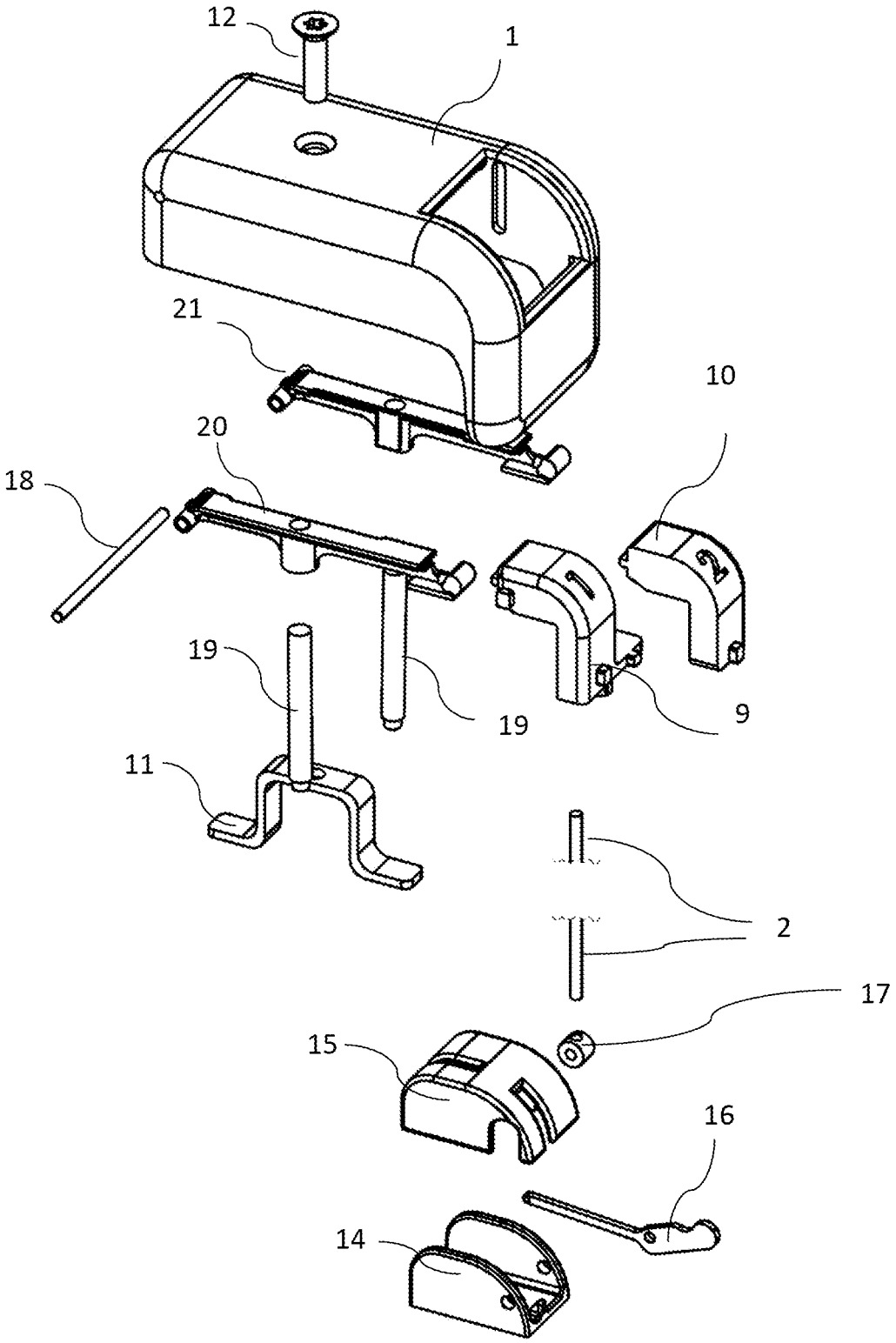
FIG. 9 is an exploded view of an embodiment of a main actuator and secondary actuator in a toilet lid and seat closer and flushing system in accordance with the present invention.

Lastly, FIG. 9 is an exploded view of an embodiment of a main actuator and secondary actuator in a toilet lid (or lid and seat) closer and flushing system in accordance with the present invention. This figure shows the component parts of the main actuator (1), the secondary actuator (6) along with the various components that make up the system. The closing buttons (9, 10), and the connector rod (2), and the panel fixing screw (12) are visible, as well as the internal lock (11) that allows for the secure attachment of the panel to the existing toilet lid. The parts of the secondary actuator (6) shown in the figure are the secondary actuator support (14), the secondary actuator cover (15), and the secondary actuator strike knob (16). The articulated link (17) between the connector rod (2) and the strike knob (16) is also visible. The 2nd degree levers (20, 21) and the regulatory screws (19) used for adjusting the time delay between the activation of the closing buttons and the actual flushing until the closing of the toilet seat has been completed are also shown, as well as the pivot axis and support (18) for the 2nd degree levers.

The description as set forth is not intended to be exhaustive or to limit the invention to the precise form disclosed. Many modifications and variations are possible in light of the teachings above without departing from the spirit and scope of the forthcoming claims.

The invention claimed is:

1. A toilet lid and seat closer and flushing system comprising a main actuator connected to a secondary actuator through a connector rod, wherein said main actuator comprises at least a first closing button for partial flushing and a second closing button for full flushing and said second actuator closes said toilet's lid, wherein said first and second closing buttons also act as a flushing buttons, simultaneously activating water flushing and lid closure, and wherein said secondary actuator comprises a strike knob that activates closure of said toilet's lid when pressed, an articulated link between the connector rod and the strike knob and a secondary actuator support and cover to protect the second actuator from external elements.

2. A toilet lid and seat closer and flushing system of comprising a mechanical timer and a main actuator connected to a secondary actuator through a connector rod, wherein said main actuator comprises at least a first closing button for partial flushing and a second closing button for full flushing and said second actuator closes said toilet's lid, wherein said first and second closing buttons also act as a flushing buttons, activating lid closure first and water flushing subsequently, wherein said secondary actuator comprises a strike knob that activates closure of said toilet's lid when pressed, an articulated link between the connector rod and the strike knob and a secondary actuator support and cover to protect the second actuator from external elements, and wherein said mechanical timer delays water flushing until closing of said toilet's lid has been completed.

3. The toilet lid and seat closer and flushing system of claim 2, further comprising a sealing rubber on said toilet's lid to provide a hermetic seal against said toilet's seat, and a sealing rubber on said toilet's seat to provide a hermetic seal against said toilet's bowl.

4. The toilet lid and seat closer and flushing system of claim 3, further comprising an accessory handle.

* * * * *